US007623333B2

(12) United States Patent
Robertson

(10) Patent No.: US 7,623,333 B2
(45) Date of Patent: Nov. 24, 2009

(54) ION CHIP OPERATING MODULE

(76) Inventor: Reginald R Robertson, Apartment 201, 605 River Avenue, Winnipeg, Manitoba (CA) R3L 0E7

( * ) Notice: Subject to any disclaimer, the term of this patent is extended or adjusted under 35 U.S.C. 154(b) by 0 days.

(21) Appl. No.: 12/010,231

(22) Filed: Jan. 23, 2008

(65) Prior Publication Data

US 2009/0185324 A1 Jul. 23, 2009

(51) Int. Cl.
*H01T 23/00* (2006.01)

(52) U.S. Cl. ..... 361/231; 361/230; 361/234

(58) Field of Classification Search ..... 361/230–232, 361/234

See application file for complete search history.

(56) References Cited

U.S. PATENT DOCUMENTS 3,624,448 A * 11/1971 Saurenman et al. ..... 361/231
4,272,699 A * 6/1981 Faubel et al. ..... 313/360.1
4,771,361 A * 9/1988 Varga ..... 361/231
5,034,651 A * 7/1991 Domschat ..... 313/351
5,065,272 A * 11/1991 Owen et al. ..... 361/231
5,141,529 A * 8/1992 Oakley et al. ..... 95/57
6,176,977 B1 * 1/2001 Taylor et al. ..... 204/176
7,161,789 B2 1/2007 Robertson
2004/0218338 A1 11/2004 Robertson

* cited by examiner

*Primary Examiner*—Stephen W Jackson
*Assistant Examiner*—Terrence R Willoughby
(74) *Attorney, Agent, or Firm*—Robert W B Bailey

(57) ABSTRACT

The ion chip operating module allows for the inevitable ionizing electrode erosion by high voltage ionization of the prior art ion chip, by extending its life, improving its performance and maintenance. A ionizing module is provided which lengthens the life of its ionizing structure by providing more ionizing electrodes, which usually operate sequentially, and also allows replacement of an exhausted module by a fresh one. The ionizing electrodes are provided by ionizing needles, conductive carbon coated fibers and mixtures thereof. The carbon coated fibers when in brush form present a very large number of potential ionizing electrodes. The module is a metal plate with the ionizing structure on one side and a pin adapted to engage a socket on the other. The advantage of injecting negative ions into air conditioning systems to enhance air quality by increasing negative ions and by precipitating particulate contaminants is known.

20 Claims, 4 Drawing Sheets

ION CHIP OPERATING MODULE

This application is directed to an improved ion chip and operating module for generating atmospheric ions, preferably negative ions.

The ion chip operating module was developed to overcome the inevitable ionising electrode erosion by high voltage ionisation of the prior art ion chip of U.S. Pat. No. 7,161,789 hereby incorporated by reference. The module extends operating life, improves operating performance, and eases maintenance, of systemic application of negative ionising emitters to improve indoor air quality. The ion chip operating module is an insert to connect to the metallic surface of the ion chip, it has more ionising electrodes than the original ion chip, which lengthens the life of the ionising structure, because the ionising electrodes usually operate sequentially until exhausted. It also allows replacement of an exhausted module by a fresh one. The ionising electrodes are provided by ionising needles, conductive carbon fibres, preferably in brush form, and mixtures thereof. The carbon fibre brush thread ends present a very large number of potential ionising electrodes. There are two forms of emitter: one to inject negative ions into ventilation airflow of (sick) buildings to correct known deficiencies in electrical air quality; the other to cause precipitation of airborne contaminants, including harmful bacteria, spores and viruses to reduce cross infection in hospitals, which is a current major problem, in view of prospective pandemics such as SARS. In both types of emitter the output profile of strongly focused air ion streams can be determined by the number, spacing and arrangement of modules within an emitter, typically linearly spaced, and the arrangement of emitters in an array, to achieve the desired result of cleaner fresher air, and improved workplace, health and safety.

The invention is directed to an ion chip operating module which has an ionising structure mounted on one side of a metal plate and a metal projection mounted on the other side, the metal projection is adapted to engage a metal lined recess physically and electrically. An ion chip base has a metal plate or surface, having a recess to engage the projection of the module. In use module and base form the ion chip, with the ionising structure providing an ion stream and the base providing an electrostatic repulsing field to direct the ion stream or flow from the ionising structure. Typically insulating walls are provided to protect and ambush the ionising structure. The purpose of the invention is to allow for the inevitable erosion of the ionising electrodes inherent in the ionising process and not now dependant on a single ionising needle or random surface threads of carbon fibre yarn to obtain and maintain systemic operation of the technology. In use the ion chip metallic surface is electrically connected to one pole of a high voltage generator.

Although the invention is described and referred to specifically as it relates to specific modular ionising structure conductive surface combinations for generating atmospheric ions, it will be understood that the principles of this invention are equally applicable to similar ionising structure conductive surface combinations and accordingly, it will be understood that the invention is not limited to such modular ionising structure conductive surface combinations for generating atmospheric ions.

PRIOR ART AND BACKGROUND

The invention is an improvement on the ion chip of U.S. Pat. No. 7,161,789 B2 issued Jul. 9, 2007 to instant applicant, which teaches an ionising structure physically mounted on and in electrical contact with a metallic surface of the ion chip. One pole of a high voltage generator is connected to the metallic surface to provide a high voltage. The ionising structure emits a stream of ions generated by corona discharge from one or more ionising electrodes, while the metallic surface provides an electrostatic repulsing field which directs the ion stream outward. Generally there are insulating walls projecting outward near the ionising structure forming a channel construction to protect it. Although the ionising structure can generate both positive and negative ions, in general for air cleaning, conditioning, freshening and purifying negatively charged atmospheric ions are generated.

Negatively charged atmospheric ions have two primary effects in air cleaning, conditioning, freshening and purifying. One is the introduction of negative ions to change the ionic balance of the incoming ventilating air, which of itself is considered beneficial. In fact the metal ducts of modern air conditioning systems act as ground removing negatively charged ions from the air leaving positively charged ions. The second is to precipitate particulate matter from the air, most contaminants are particulate in nature, thus cleaning or purifying the air. In hospitals the particulate matter includes bacteria, As it is thought much iatrogenic (hospital generated) disease is caused by airborne bacteria, reducing particulate matter should reduce iatrogenic infection. Both effects are important when air is recycled or recirculated in buildings. The emitters can also be used to provide an ionic barrier across a doorway or corridor to reduce particulate matter, thus bacteria levels and so any resulting infection.

OBJECTS OF THE INVENTION

The main thrust of the invention is to provide an improved ionising structure for the ion chip. The original carbon fibre yarn had few ionising electrodes which degraded over time. This is overcome in two ways, first by providing a replaceable ionising structure in the form of a module, and second by providing many more ionising electrodes in the ionising structure, which extends the effective life of the module. It is a principal object of the invention to provide an ionising module having a flat metal surface bearing an ionising structure extending substantially vertically from the metal surface and a metal projection extending from the other side of the surface, the metal projection being adapted to engage a recess, the ionising structure comprising a plurality of corona forming ionising electrodes, selected from the group consisting of ionising needles, conductive carbon coated fibres and mixtures thereof, whereby when sufficient high voltage is applied to said ionising structure through said metal surface and said metal projection said ionising structure generates ions. A subsidiary object of the invention is to provide an ionising module, where the surface is a metal plate, the projection is a pin and the recess is a socket. It is a further subsidiary object of the invention to provide an ionising module where the ionising structure is a plurality of ionising needles. It is a further subsidiary object of the invention to provide an ionising module where the ionising structure is conductive carbon coated fibres. It is a further subsidiary object of the invention to provide an ionising module wherein the ionising structure is at least one and preferably a plurality of carbon fibre brushes, both fibres and brushes being aligned substantially vertically to the metal surface, impaled on ionising needles or pins substantially vertical to the metal surface. It is a further subsidiary object of the invention that the brushes be bound with fine copper wire. It is a further principal object of the invention to provide an ion chip combining the ion module of the invention with an insulated base having a base metal surface having a socket to engage the projection of the ionising module. It is a subsidiary object of the invention to provide a pin as projection and a socket as recess. It is further subsidiary object of the invention to provide and ion chip having a plurality ion modules with projections engaging recesses in the metallic surface of said insulated base. It is a further subsidiary object of the invention to provide a surrounding insulated wall projecting from the base metal surface adjacent the module and projecting a greater distance from the base metal surface than the ionising structure. It is a further subsidiary object of the invention to provide a wedge shaped side of the insulated base opposed to said ionising structure to split airflow flowing past the ion chip from the insulated side to the ionising side. It is a further subsidiary object of the invention to provide a base metallic surface extending beyond the module metal surface to provide a repulsing electrostatic field when said high voltage is applied thereto. It is a further object of the invention to provide paired opposed parallel insulating walls projecting from the base metal surface adjacent the ionising structure of the module and the insulating walls project a greater distance from the base metal surface than said ionising structure to protect and ambush the ionising structure. Other objects of the invention will be apparent to those skilled in the art from the following specification, accompanying drawings and appended claims.

DESCRIPTION OF THE INVENTION

In one broad aspect the invention is directed to an ionising module comprising a flat metallic surface having an ionising structure extending substantially vertically therefrom and a metal projection extending from the other side of said surface said metal projection being adapted to engage a recess. The ionising structure comprises a plurality of corona forming ionising electrodes, selected from the group consisting of ionising needles, conductive carbon coated fibres and mixtures thereof, whereby when sufficient high voltage is applied to said ionising structure through said metal surface and said metal projection said ionising structure generates ions.

Preferably the metal surface is a metal plate and the projection is a pin and the recess is a socket. The ionising structure comprises a plurality of ionising needles; conductive carbon coated fibres; and mixtures thereof. The carbon fibres can be at least one and preferably a plurality of carbon fibre brushes, both brushes and the fibres in the brushes are preferably aligned substantially vertical to the metal surface or plate. Each brush is impaled on a pin or ionising needle substantially vertical to said metal surface. Ionising needles are preferred as providing more ionising electrodes. Preferably the carbon fibre-brushes are brushes are bound by copper wire.

The invention in a further aspect is directed to an ion chip comprising the module of the invention in combination with an insulated base having a base metal surface. This base metal surface includes a recess to engage the projection of the module, and the base has an opposed side to said metal surface. Preferably the projection is a pin and the recess is a socket. The ion chip can have a plurality of ion modules with projections engaging recesses in the metal surface of the insulated base. The insulated base may have a surrounding insulated wall projecting from the metal surface adjacent the ionising structure of the module and the insulating wall projects a greater distance from the metal surface than the ionising structure, so as to protect the ionising structure. The opposed side of the insulating base may be wedge shaped to split airflow flowing past the ion chip from its insulated side to its ionising side. Preferably the base metal surface extends beyond the module metal surface to provide a repulsing electrostatic field when said high voltage is applied thereto. Paired opposed parallel insulating walls may project from the base metal surface adjacent the ionising structure of the module and the insulating wall projects a greater distance from the base metal surface than the ionising structure, to protect and ambush the ionising structure. The ion chip may have a plurality of ion modules with projections engaging recesses in the metal surface of the insulated base and these modules are between the insulating walls. Preferably the module has a pin engaging a metal socket in the metal surface of the base, the ionising structure being physically and electrically connected through the pin to the base metal surface, whereby when sufficient high voltage is applied to the base metal surface by a high voltage generator, the ionising structure generates ions directed in a stream by an electrostatic repulsing field on the module metal surface. The base metal surface may extend beyond the module metal surface whereby when sufficient high voltage is applied to the base metal surface by a high voltage generator, the ionising structure generates ions directed in a stream by an electrostatic repulsing field on both the module metal surface and the base metal surface. In this case preferably an insulating wall projects from the base metal surface adjacent the ionising structure of the module and the insulating wall projects a greater distance from the base metal surface than the ionising structure, to protect the ionising structure, the base metal surface extending beyond the insulating wall.

DESCRIPTION OF THE PREFERRED EMBODIMENTS

Figure 1:
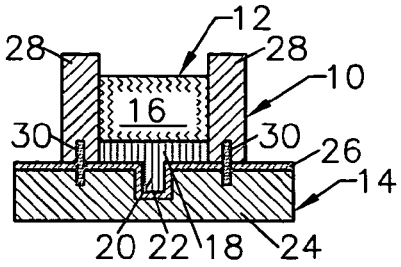
FIG. 1 shows a sectional view of an embodiment of an ion chip of the invention.
Figure 2:
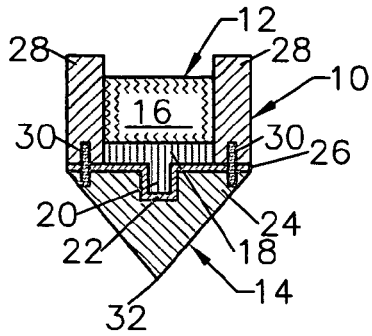
FIG. 2 shows a sectional view of a second embodiment of an ion chip of the invention.
Figure 3:
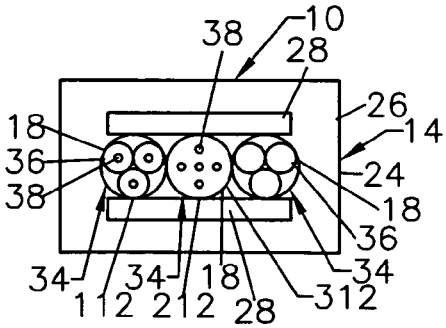
FIG. 3 shows a plan view the embodiment of FIG. 1.
Figure 4:
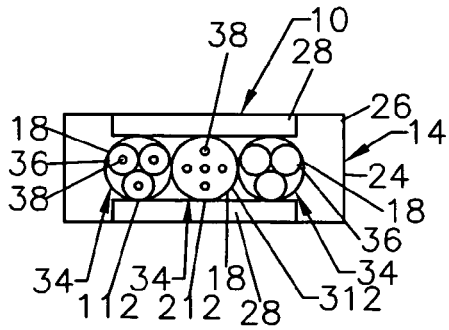
FIG. 4 shows a plan view of the embodiment of FIG. 2.
Figure 5:
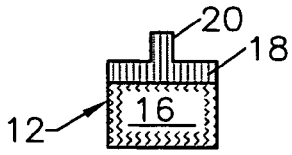
FIG. 5 shows a sectional side view of a general embodiment of a module of the invention.
Figure 6:
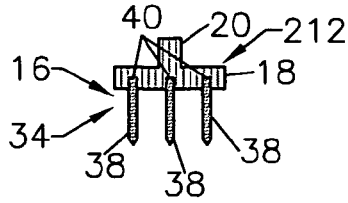
FIG. 6 shows a sectional side view of a specific embodiment of the module of the invention.
Figure 7:
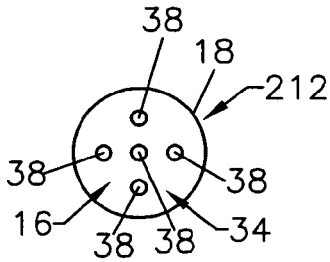
FIG. 7 shows a plan view of the embodiment of FIG. 6.
Figure 8:
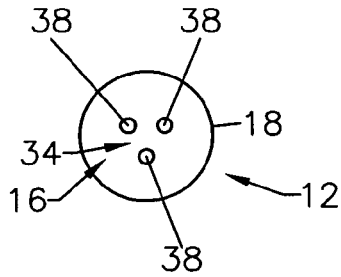
FIG. 8 shows a plan view of another specific embodiment of FIG. 5.
Figure 9:
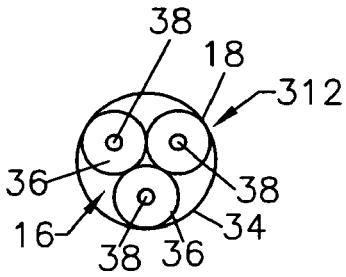
FIG. 9 shows a plan view of another specific embodiment of FIG. 5.
Figure 10:
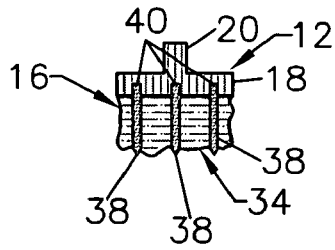
FIG. 10 shows a side sectional view of another specific embodiment of FIG. 5.
Figure 11:
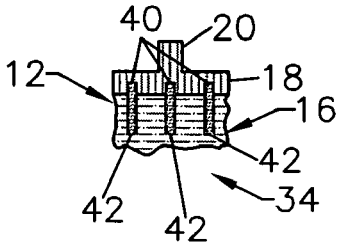
FIG. 11 shows a side sectional view of another specific embodiment of FIG. 5.
Figure 12:
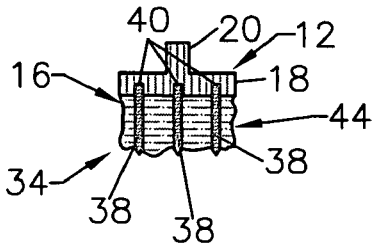
FIG. 12 shows a side sectional view of another specific embodiment of FIG. 5.
Figure 13:
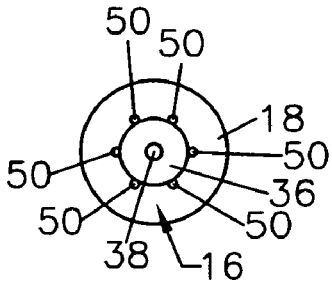
FIG. 13 shows a plan view of another specific embodiment of FIG. 5.
Figure 14:
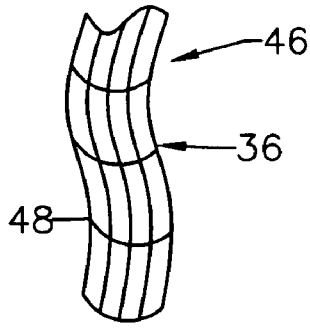
FIG. 14 shows a side view of a carbon fibre ionising brush of the invention.

The invention is illustrated by reference to preferred embodiments thereof. In FIG. 1 numeral 10 indicates an ion chip of the invention having module 12 and support 14. Module 12, about ¾ inch (about 2 cm) across is shown with ionising structure 16, plate 18 and pin 20 which engages recess or socket 22 in support 14 which has insulating base 24 on which is metal surface 26, typically the metallic layer of a printed circuit board. Insulating walls 28 about ¼ inch (about 6 mm) across project about ¾ inch (about 2 cm) and are attached by pins 30 to base 24 and project from metal surface 26. In use ions generated flow from ionising structure 16 channelled by walls 28 and directed by the electrostatic field of metal surface 26. In FIG. 2, base 24 of support 14 is shaped as wedge 32 so that air flowing upstream past the ion chip from the bottom is split while the ion flow generated flows upward into the air flow downstream of the chip, this version directs its ion flow longitudinally into the air flow, and is intended to inject negatively charged ions into the air. As shown in FIG. 3, for illustrative purposes, several forms of ionising structure may be used: module 112 has an array 34 of three ionising brushes 36 each impaled by ionising needles 38 mounted on plate 18; module 212 has an array 34 of five ionising needles 38 mounted on plate 18; module 312 has with three ionising brushes 36 mounted on plate 18. In these cases plate 18 is a metal disc, and metal surface 26 provides a repulsing electrostatic field as do plates 18. In FIG. 4, similarly, again for illustrative purposes, several forms of ionising structure may be used: module 112 has an array 34 of three ionising brushes 36 each impaled by ionising needles 38 mounted on plate 18; module 212 has an array 34 of five ionising needles 38 mounted on plate 18; module 312 has with three ionising brushes 36 mounted on plate 18. In these cases plate 18 is a metal disc, and metal surface 26 provides a repulsing electrostatic field as do plates 18. The ion chips of FIGS. 1 and 3, are generally used to inject ions transversely into an air flow to precipitate particulate matter, metal surface 26 is used to direct and focus the ion flow or stream. The ion chips of FIGS. 2 and 4 are used to inject ions longitudinally (downstream) into an airflow. In use one pole typically the negative pole of a high voltage generator is connected electrically to metal surface 26. In FIG. 5, is shown a generic module 12 of the invention having ionising structure 16, metal plate 18 and integral metal locating pin 20. Metal plate 18 is preferably ¾ or 11/16 inch diameter disc (about 1¾ to 2 cm), 3/16 inch thick (about ½ cm), the plate can be smaller and thinner as appreciated by those skilled in the art. Metal pin 20 is typically 3/16 inch diameter and projects 3/16 inch (both about ½ cm). The metal is preferably high grade conductivity copper. Ionising structure typically extends outward from plate 18 about ½ inch (about 1¼ cm). In FIGS. 6 and 7 module 212 has ionising structure 16 which is an array 34 of ionising needles 38 embedded in holes 40 in plate 18. Ionising needles 38 are hardened steel 21/32 inch long (about 1½ cm) and ⅛ inch diameter (about 3 mm) socketed in cylindrical holes 40 ⅛ inch less ten thousandths inch diameter for tight fit (about 3 mm) and ⅛ inch deep (about 3 mm), holes 40 can also be ⅛ inch less five thousandths of an inch diameter for tight fit, five ionising needles 38 are shown, but as those skilled in the art are aware, up to seven is possible, or even more by suitably close packing ionising needles 38 ⅛ inch diameter (3 mm) needles, with holes 40 suitably spaced so as not to be contiguous and weaken plate 18. Although not preferred ionising needles 38 can be 1/16 inch diameter (about 1½ mm) sunk into holes 40 of 1/16 inch less five thousandths inch (about 1½ mm) diameter for tight fit and ⅛ inch deep (about 3 mm) can be used and a greater number can be placed on plate 18. FIG. 8 shows module 12 with ionising structure 16 having array 34 of three ionising needles 38. FIG. 9 shows module 312 with ionising structure 16 having an array 34 of three ionising brushes 36 of conductive carbon coated fibres impaled on three ionising needles 38 each 1/16 inch diameter (about 1½ mm). FIG. 10 show a similar embodiment to FIG. 9 of module 12 with array 34 of ionising brushes 36 impaled on ionising needles 38 each 1/16 inch diameter (about 1½ mm). FIG. 11 show a similar embodiment to FIGS. 9 and 10 using array 34 of pins 42 1/16 inch diameter (about 1½ mm) instead of ionising needles 38. FIG. 12 shows a related embodiment to FIGS. 9, 10, 11 where module 12 has ionising structure 16 with ionising layer of carbon coated fibre yarn 44, through which optional array 34 of ionising needles 38 pass either ⅛ inch (about 3 mm) or 1/16 inch (about 1½ mm), the latter preferred. FIG. 13 shows ionising structure 16 with central ionising needle 38, either ⅛ inch (about 3 mm) preferred, or 1/16 inch (about 1½ mm) diameter, impaling ionising brush 36, surrounded by ionising needles 50 1/16 inch (about 1½ mm) diameter forming a cage to hold the brush in place. FIG. 14 shows ionising brush 36 is a thick short stub of carbon fibre yarn 46 wound about by fine copper wire 48, with its ionising end forming a mass of carbon fibre thread ends providing a multiplicity of potential ionising electrodes, typically the brush is ⅛ inch (about 1 cm) diameter and about ½ inch (about 1¼ cm) long. The preferred forms of ionising structure are: a short stub brush of twisted carbon fibre yarn material bound by fine copper wire held upright by being impaled on a metal support pin from a metal plate; a cluster of ionising needles as closely spaced as possible; a combination of ionising brush and needles, possibly the impaling metal pins can be ionising needles. While as in FIG. 12 conductive carbon coated fibre yarn can be used, it has far fewer ionising electrodes and thus a much shorter life, and so is less preferred. Different arrangements of ionising structures within an emitter have different ion emission characteristics allowing modification of ion streams, as do different arrays of emitters. Although injection of ions into air flows and streams to improve air quality by changing ion balance, is different from injection of ions to precipitate contaminant particles, the identical module can be used in both cases. It is preferred to provide a metal surface for a repulsing electrostatic field to focus or direct the ion flow or stream in the case of precipitation so as to direct the ion stream across the air flow. The metal surface and repulsing electrostatic field are less necessary in improving air quality. As many ionising electrodes as possible are preferred per module as possible. Several ionising needles are needed to extend the life of the ionising structure, as the needles erode with use. Similarly ionising brushes provide even more carbon fibre end to act as ionising electrodes. As the ionising electrodes replace each other in turn, with only one ionising electrode working at a time, all the potential ionising electrodes must lie within a minimum distance, so that the corona discharge of the working ionising electrode suppresses other potential electrodes supported by plate 18. This is the corona plasma stress cone suppression effect which is known, and permits only one dominant electrode to emit at a time. When this burns out another electrode will become dominant, as it is outside any corona cone and emit automatically it its turn. As a random dynamic discriminating sequence of events, some electrodes will leave and return to the pool of potential electrodes, extending the operating life of the module. The stub brush of carbon fibre yarn ends provides many more potential electrodes than the random surface of carbon fibre yarn previously used. The numbers of ionising needles and carbon fibre stub brushes shown are illustrative rather than restrictive. The farthest distance between electrodes should be chosen so that the corona discharge of one working ionising electrode suppresses other potential electrodes on the same plate or disc. The corona suppression cone is about ⅜ in, (about 1 cm) diameter so all the electrodes should lie within this distance of each other. As many electrodes as possible should lie within the corona suppression cone. If the ionising structure is larger than the corona suppression zone, then more than one electrode may emit ions at a time, which provided that the number is small, is acceptable, though not preferred. When ionising needles are used these are typically about ½ inch (about 1¼ cm) tall and up to ⅛ inch (about 3 mm) diameter. Generally the longest electrode activates first as ionising electrode, and is then replaced. With the thicker ionising needles a needle may activate then be replaced, and then become active again. In the precipitation ion chip, as for example shown in FIGS. 1 and 3, the base is perhaps 4 inches (10 cm) long, although this size is not critical, the channel is about ¾ inch (about 2 cm) across, the insulating walls are about ½ inch (about 1¼ cm) across and deep enough about ¾ inch (about 2 cm) to protect ionising needles, the structure is about 1¾ to 2 inch across (about 4½ to 5 cm), to allow metal surface 26 to direct or focus the ion flow or stream. While discs are shown in the figures, the shape is not critical, it is greatly preferred that all potential ionising electrodes lie within the suppressor cone of corona discharge of one of the electrodes, and that the plate fits between insulating walls. Two types of emitter are envisaged, one is to inject negative ions into incoming air of incoming ventilation air diffusers in a conventional HVAC 2 installation to correct known deficiencies in "electrical air quality" typically an excess of positive ions as normal country air has 1800 positive and 1600 negative ions per milliliter, excess positive ions being believed deleterious to healthy air. The emitters can be retrofitted or integral to the HVAC diffuser, the embodiment of FIGS. 2 and 4 is preferred for this function, the upstream wedge structure splits incoming airflow to either side of the emitter, which will multiply the emitter static output (ion generation) as a function of ventilating air velocity. The same arrangement avoids any direct impingement of incoming air onto the ionising structure, thus protecting it from erosion or build up of contaminants from the incoming air to be treated. Alternatively the emitter is used to precipitate and immobilize air borne contaminants, of micrometric or submicrometric particle size (micrometer is $10^{-6}$ meter) such as bacteria. The metallic surface layer of the ion chip base is extended to each side of the channel formed by insulating walls, to provide an electrostatic repulsing field to focus the ion flow or stream, as in FIGS. 1 to 4. Here the emitter should ideally be arranged directly above the polluting source. An emitter mounted on a ceiling tile would fit in well where false suspended ceilings exist, as downward ventilating air would assist downward flow of focussed ion streams or flows. A system of this sort (contaminant precipitating) has achieved demonstrated success in a wide range of industrial manufacturing and processing operations to achieve higher standards of workplace health and safety, increased productivity through reduced contamination of finished products (removal/reduction of airborne dust). Recent applications in dental and medical premises has controlled the spread of infection. A byproduct is that after precipitation some bacteria and viruses are rendered harmless and unable to colonise, when negative ion bombardment is continued.

Module pin 20 and recess 22 preferably embody conventional engaging means, such as screw threads preferred, or a bayonet joint.

The high voltage supply is preferably generated by an electronic ion generator which comprises a printed circuit board housed in a strong insulated box, with a uni-polar negative output, with full wave rectification and a miniature step-up instrument transformer of limited short circuit capacity to ensure minimum ignition energy cold sparking under fault and limited threshold CD value of about 7 kV to ensure limited ozone considerably within the EDA recommendation of 50 parts per billion, preferably much less. Such a generator can supply both positive and negative voltages and ions.

The ion chips are designed to operate with the lesser negative voltage which generates ozone at acceptable levels (preferably none). By connecting the system to a suitable higher negative voltage the ion chip can actively generate ozone as a fumigating agent, for treating air borne bacteria such as pathogenic microbes, in the absence of humans and livestock.

As those skilled in the art would realize these preferred described details and materials and components can be subjected to substantial variation, modification, change, alteration, and substitution without affecting or modifying the function of the described embodiments.

Although embodiments of the invention have been described above, it is not limited thereto, and it will be apparent to persons skilled in the art that numerous modifications and variations form part of the present invention insofar as they do not depart from the spirit, nature and scope of the claimed and described invention.

The invention claimed is:

1. An ionizing module comprising a flat metal surface having an ionizing structure extending substantially vertically from said metal surface and a metal projection extending from the other side of said surface said metal projection being adapted to engage a recess, said ionizing structure comprising a plurality of corona forming ionizing electrodes, selected from the group consisting of ionizing needles, conductive carbon coated fibres and mixtures thereof, whereby when sufficient high voltage is applied to said ionizing structure through said metal surface and said metal projection said ionizing structure generates ions.

2. Ionizing module of claim 1, wherein said surface is a metal plate and said projection is a pin and said recess is a socket.

3. Ionizing module of claim 1, wherein said ionizing structure comprises a plurality of ionizing needles.

4. Ionizing module of claim 1 wherein said ionising structure comprises conductive carbon coated fibres.

5. Ionizing module of claim 4, wherein said carbon fibres comprise a plurality of carbon fibre brushes, said brushes and said fibres in said brushes being aligned substantially vertical to said surface, and each said brush being impaled on a pin substantially vertical to said metal surface.

6. Ionizing module of claim 1, wherein said ionising structure comprises a plurality of ionizing needles and conductive carbon coated fibres.

7. Ionizing module of claim 6, wherein said carbon fibres comprise at least one carbon fibre brush, said brush and said fibres in said brush being aligned substantially vertical to said plate, and each said brush being impaled on an ionizing needle substantially vertical to said metal surface.

8. Ionizing module of claim 7, comprising a plurality of carbon fibre brushes, each said brush being bound by copper wire.

9. Ionizing module of claim 8 wherein said brushes are bound by copper wire.

10. An ion chip comprising the module of claim 1 in combination with an insulated base having a base metal surface, said base metal surface including a recess to engage the projection of the module, and said base has an opposed side to said metal surface.

11. Ion chip of claim 10 wherein said projection is a pin and the recess is a socket.

12. Ion chip of claim 10 wherein said ion chip has a plurality of ion modules with projections engaging recesses in said metal surface of said insulated base.

13. Ion chip of claim 10 wherein said insulated base has a surrounding insulated wall projecting from said base metal surface adjacent said ionizing structure of said module and said insulating wall projects a greater distance from said base metal surface than said ionizing structure.

14. Ion chip of claim 13 wherein said opposed side of said insulating base is wedge shaped to split airflow flowing past said ion chip from the insulated side to the ionizing side.

15. Ion chip of claim 10 wherein the base metal surface extends beyond said module metal surface to provide a repulsing electrostatic field when said high voltage is applied thereto.

16. Ion chip of claim 15 having paired opposed parallel insulating walls projecting from said base metal surface adjacent said ionizing structure of said module and said insulating wall projects a greater distance from said base metal surface than said ionizing structure.

17. Ion chip of claim 16 wherein said ion chip has a plurality of ion modules with projections engaging recesses in said metal surface of said insulated base and said modules are between said insulating walls.

18. Ion chip of claim 10 wherein said module has a pin engaging a metal socket in the metal surface of said base, said ionizing structure being physically and electrically connected through said pin to said base metal surface, whereby when sufficient high voltage is applied to said base metal surface by a high voltage generator, said ionizing structure generates ions directed in a stream by an electrostatic repulsing field on said module metal surface.

19. Ion chip of claim 10 wherein said module has a pin engaging a metal socket in the metal surface of said base, and said base metal surface extends beyond said module metal surface, said ionizing structure being physically and electrically connected through said pin to said base metal surface, whereby when sufficient high voltage is applied to said base metal surface by a high voltage generator, said ionizing structure generates ions directed in a stream by an electrostatic repulsing field on said module metal surface and on said base metal surface.

20. Ion chip of claim 19, wherein an insulating wall projects from said base metal surface adjacent said ionizing structure of said module and said insulating wall projects a greater distance from said base metal surface than said ionizing structure, said base metal surface extending beyond said insulating wall.

* * * * *